US005472024A

United States Patent [19]

Brugerolle et al.

[11] Patent Number: 5,472,024

[45] Date of Patent: Dec. 5, 1995

[54] INDUSTRIAL GAS FEEDING ASSEMBLY FOR PORTABLE UTILIZING APPARATUS

[75] Inventors: Jean-Renaud Brugerolle; Alain Robin, both of Paris, France

[73] Assignee: L'Air Liquide, Societe Anonyme Pour l'etude et l'exploitation des Procedes Georges Claude, Paris, France

[21] Appl. No.: 146,186

[22] PCT Filed: Mar. 29, 1993

[86] PCT No.: PCT/FR93/03313

§ 371 Date: Nov. 16, 1993

§ 102(e) Date: Nov. 16, 1993

[87] PCT Pub. No.: WO93/20383

PCT Pub. Date: Oct. 14, 1993

[30] Foreign Application Priority Data

Mar. 31, 1992 [FR] France ..... 92 03898

[51] Int. Cl.[6] ..... B65B 1/30; B65B 31/00

[52] U.S. Cl. ..... 141/95; 141/39; 141/113; 141/231; 141/351; 220/581; 128/204.18

[58] Field of Search ..... 141/18, 37, 39, 141/95, 113, 231, 325, 351, 353, 359; 220/581, 411, 901; 128/204.18, 205.24, 201.25, 201.26, 201.27, 200.19, 201.28; 266/48

[56] References Cited

U.S. PATENT DOCUMENTS

| | | | |
|---|---|---|---|
| 2,996,213 | 8/1961 | Mitchell et al. | 220/411 |
| 3,197,851 | 8/1965 | Aleck | 220/581 |
| 3,199,303 | 8/1965 | Haumann et al. | 62/50 |
| 4,573,665 | 3/1986 | Strohl et al. | 266/48 |
| 4,722,333 | 2/1988 | Bartos | 128/204.18 |
| 4,794,923 | 1/1989 | Bartos | 128/205.24 |

FOREIGN PATENT DOCUMENTS

| | | |
|---|---|---|
| 853231 | 10/1952 | Germany . |
| 8308999 | 11/1983 | Germany . |
| 1294881 | 11/1972 | United Kingdom . |

*Primary Examiner*—Henry J. Recla
*Assistant Examiner*—Steven O. Douglas
*Attorney, Agent, or Firm*—Young & Thompson

[57] ABSTRACT

An assembly comprising an intermediate volume of medium-pressure gas (8) in a transportable housing (3) which is advantageously combined with a user apparatus (4) and selectively connectable to a high-pressure gas supply (1) by coupling it to a filling unit (2) via a quick connection system (15, 16). The assembly is particularly useful in portable welding apparatuses.

15 Claims, 5 Drawing Sheets

INDUSTRIAL GAS FEEDING ASSEMBLY FOR PORTABLE UTILIZING APPARATUS

FIELD OF THE INVENTION

The present invention concerns gas utilizing apparatuses, for example industrial and, more particularly, a gas feeding assembly, from a source of high pressure gas, of a portable utilizing apparatus which utilizes said gas.

BACKGROUND OF THE INVENTION

Apparatus which utilizes industrial gas, in particular for welding and medical applications, are supplied by means of gas bottles, which are often heavy, in which the autonomy generally exceeds the needs of the pinpoint application of the apparatus. For the utilization of the latter, it is often necessary to carry the bottle, and its cumbersomeness and its weight weigh heavily on handiness and security of use. The use of small bottles, of smaller capacity, cause problems of restocking to the user, and to the suppliers, that of the multiplicity of the sizes of the bottles to be conditioned and delivered.

SUMMARY OF THE INVENTION

It is an object of the present invention to propose a gas feeding assembly which eliminates these problems, and largely facilitates the use of apparatuses and the supply of feeding gas, without notable excessive investment costs, enabling a better management of gas consumption and offering an increased security.

For this purpose, according to a characteristic of the invention, the assembly comprises a mean pressure intermediate gas holder connected to the utilizing apparatus and selectively, rapidly and simply connectable to the source of gas and which feeds the utilizing apparatus, via a first gas control flow tap, the intermediate holder being disposed in a first casing with dismantable means for fixing the first casing to the utilizing apparatus.

According to other characteristics of the invention, the intermediate holder is associated, in the first casing, to a member for fast connection to an outlet head of a loading station, the head being permanently connected to the source of high pressure gas via a first pressure reducer and advantageously comprising a second casing having a shaped housing to receive part of the first casing and in which the outlet head is disposed.

BRIEF DESCRIPTION OF THE INVENTION

Other characteristics and advantages of the present invention will appear from the description which follows of embodiments, given by way of illustration but without limitation, with reference to the annexed drawings, in which.

DETAILED DESCRIPTION OF THE INVENTION

Figure 1:
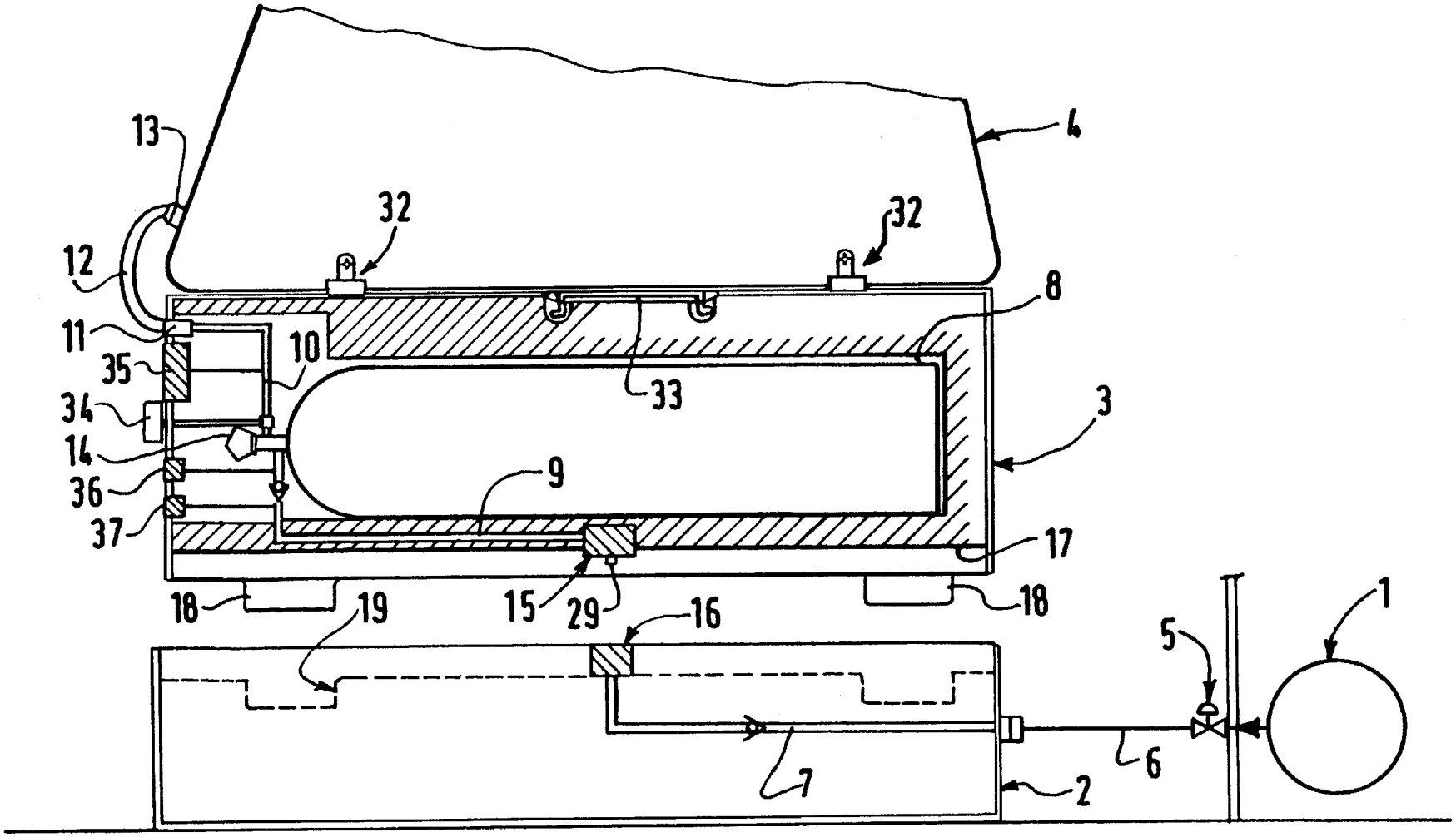
FIG. 1 is a schematic view, partially in cross-section, of a assembly for feeding gas to a portable utilizing apparatus according to the invention.

In the description which follows and in the drawings, the same or analogous elements have the same reference numerals, possibly indexed.

The assembly for feeding industrial gas illustrated in FIG. 1, which is particularly suitable for a portable welding apparatus, TIG, MIG-MAG or OXYFLAMME, essentially comprises a source of high pressure gas 1, for example argon or a mixture including argon, at a pressure typically of 200 or 300×105 Pa, a loading casing 2, and a gas reserve casing 3 associated with the portable utilizing apparatus 4. The source of high pressure gas 1, advantageously of large capacity and situated in an isolated location, replenished at regular intervals, is connected, in the illustrated example, via a first pressure reducer 5 and a flexible duct 6, to a feeding circuit 7 which is integrated in the loading casing 2, the flexible duct 6 being advantageously unitary with casing 2.

The reserve gas casing 3 includes a gas holder 8, consisting for example of a bottle of mean pressure gas, lower than $100\times10^5$ Pa, for example between 30 and $50\times10^5$ Pa, of small dimensions and made of metal or a fibrous material, and its gas inlet 9 and gas outlet 10 circuits, the latter leading, outside casing 3, through a connectable connection 11, by means of a flexible duct 12, to the feeding inlet 13 of the utilizing apparatus 4. The holder 8 includes a second pressure reducer 14 in which the outlet is connected to outlet circuit 10.

According to an aspect of the invention, the inlet of the inlet circuit 9 and the outlet of the feeding circuit 7 are both provided with cooperating members 15, 16, respectively, forming a system of rapid coupling typically of the plug-in type between circuits 7 and 9. To ensure a fast and reliable coupling between elements 15 and 16, the upper part of loading casing 2 and the lower part of gas reserve casing 3 are shaped so as to be complementary so that the lower part of casing 3 may be partially received in a perfectly defined position in loading casing 2.

Figure 2:
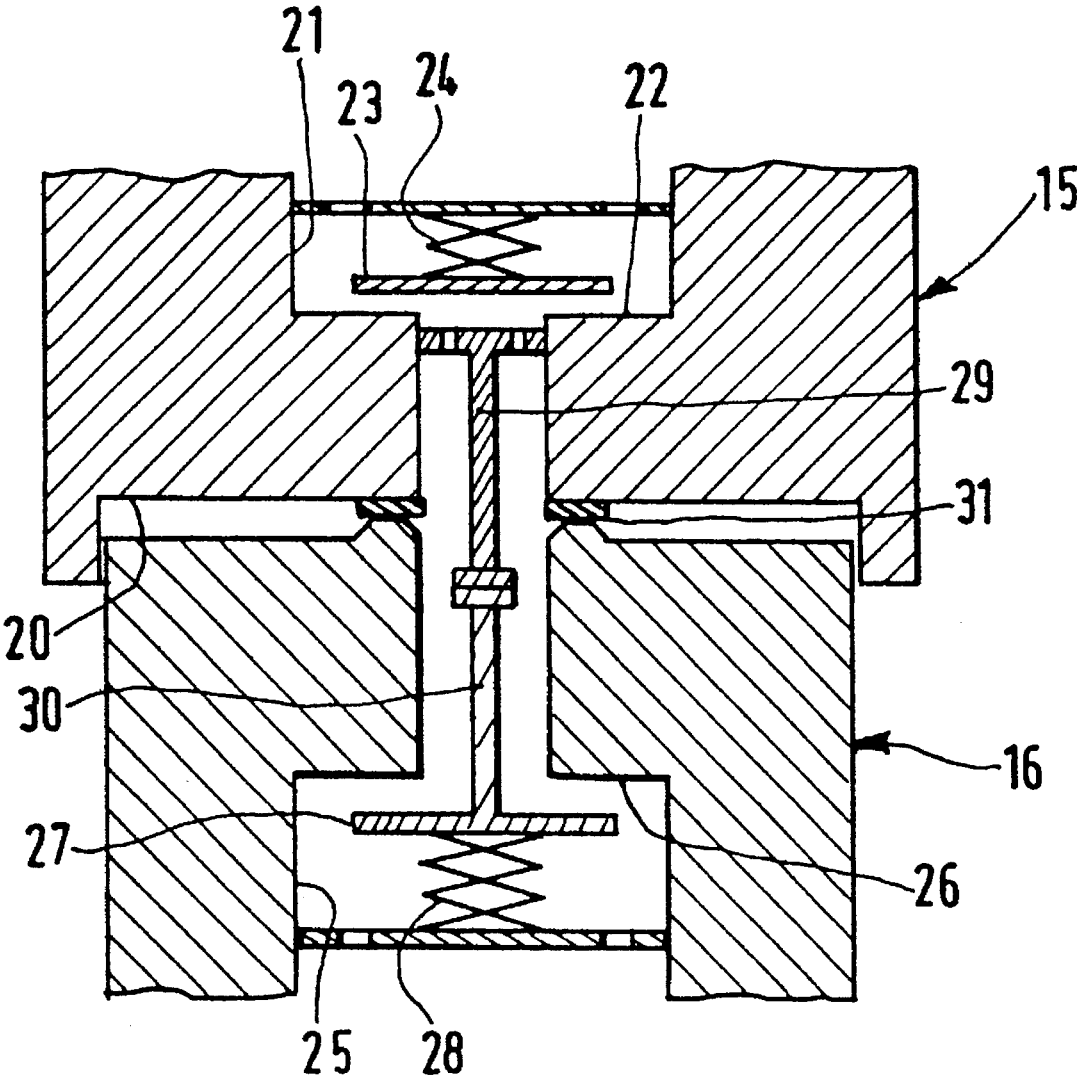
FIG. 2 is a partial view, in schematic cross-section, of the embodiment of the connecting means between the first and second casings of the assembly of FIG. 1.

In the embodiment of FIG. 1, the lower part of casing 3 has a recessed interior profile 17 with four lateral projecting feet 18, the upper part of the casing 2 forming a recess 19 which corresponds, in the sunk portion, to the interior profile of casing 3 including feet 18, so that when casing 3 is received in casing 2, the two elements 15 and 16 of the connecting means cooperate in connecting configuration as illustrated in FIG. 2. The connecting member 15, which slightly projects outwardly in recessed profile 17, includes a recess 20 which opens towards the exterior and is adapted to receive the upper end of connecting member 16 which projects outside profiled recess 19 of casing 2. Member 15 includes a gas inlet duct consisting of a stepped bore 21 including an internal shoulder 22 defining a seat for a valve element 23 which is forced in closing position, against seat 23 by means of spring 24. Similarly, member 16 includes a gas duct consisting of a stepped bore 25 including an internal shoulder 26 defining a seat for valve element 27 which is pulled into closed position, against seat 26, by means of spring 28. Member 15 includes a stationary rod 29 projecting outside the gas inlet duct and cooperating with a pusher rod 30 which is unitary with valve member 27 and extends into the gas outlet duct of member 16. Member 15 has an O-ring 31 which cooperates with a circular end projection of member 16. When mounting casing 3 into casing 2, rod 29 of member 15 pushes valve member 27 of member 16 against the pressure of pulling spring 28 and of the pressure of the gas in duct 7, the latter raising the anti-return valve 23 to thus establish, by simple mounting of casing 3 into casing 2, a connection between the source of gas 1 and the reserve holder 8 which, once filled, will accompany the utilizing apparatus 4 by providing it with a limited autonomy but leaving it free of any connection to the source of gas 1. As a matter of fact, by releasing casing 3 from casing 2, valves 23 and 24 close to perfectly insulate the circuits of theses casings from the outside.

In the embodiment illustrated in FIG. 1, the reserve casing 3 is fixed with the portable welding apparatus 4 through unlockable connecting means 32, such as anti-blocking hooks, casing 3 thus constituting a base support for apparatus 4 which prevents the latter from being in direct contact with an aggressive environment. To facilitate the individual handling of the reserve casing 3 and, for example, its transportation between the loading casing 2 and the utilization station, casing 3 has a handle 33 which can be embedded.

As illustrated in FIG. 1, the equipment of casing 3 advantageously includes a tap 34 for controlling the flow of gas which is supplied by holder 8 to apparatus 4, an indicator 35 of flow delivered, a pressure gauge 36 in holder 8 and a pilot for load 37.

In the case of a fixed installation, as illustrated in FIG. 1, the loading casing 2 is advantageously fixed on the floor of a workshop, but casing 2, as well as the source of gas 1, may also be mounted on a vehicle, for example in an ambulance for medical applications with a utilizing apparatus 4 consisting of portable oxygeno-therapy device. Finally, in the case of a source of gas consisting of a gas generator in situ, the loading casing may be associated with the generator in a compact assembly.

Figure 3:
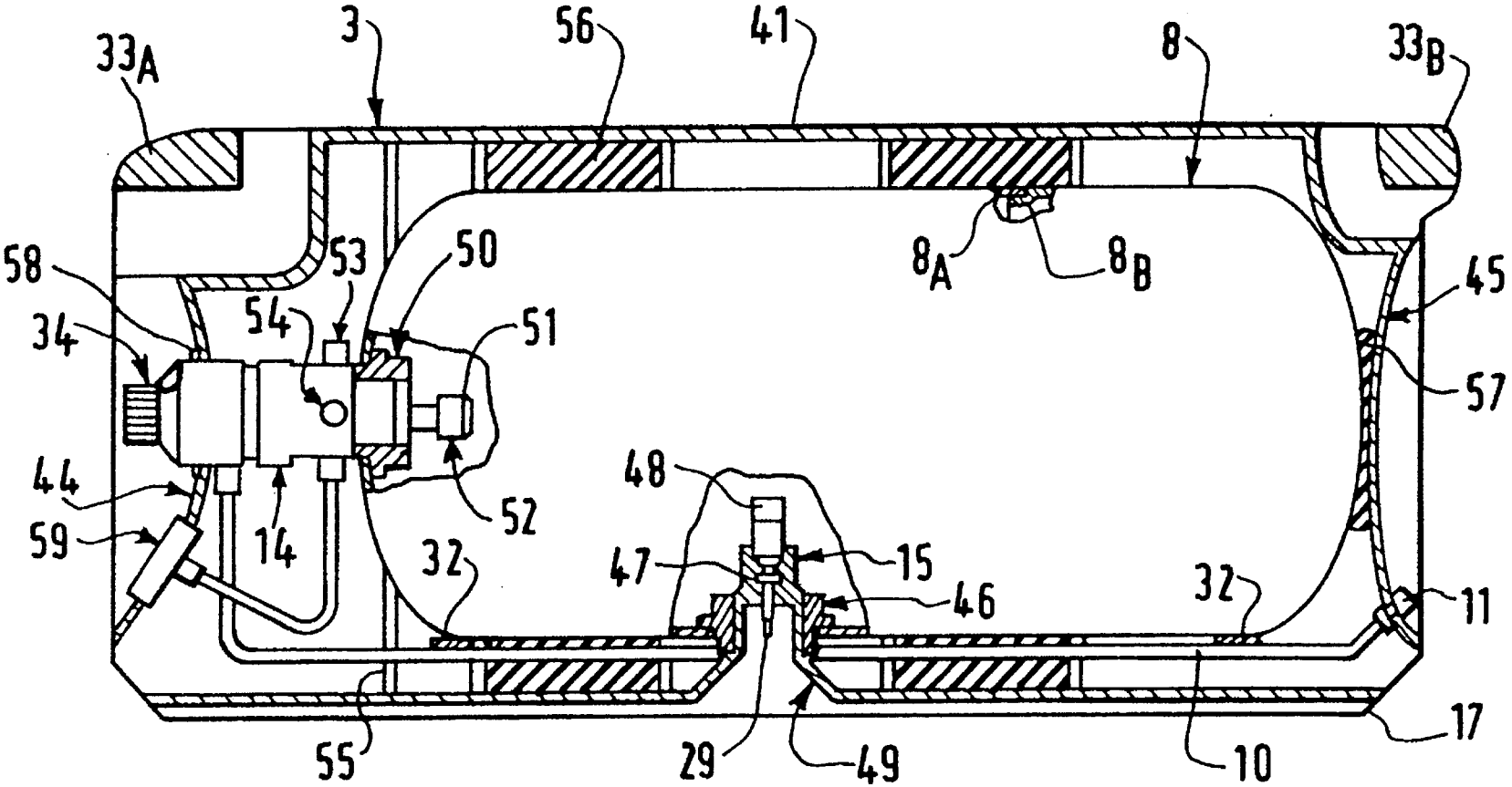
FIG. 3 is a longitudinal cross-section view of an industrial embodiment of the gas reserve casing according to the invention.
Figure 5:
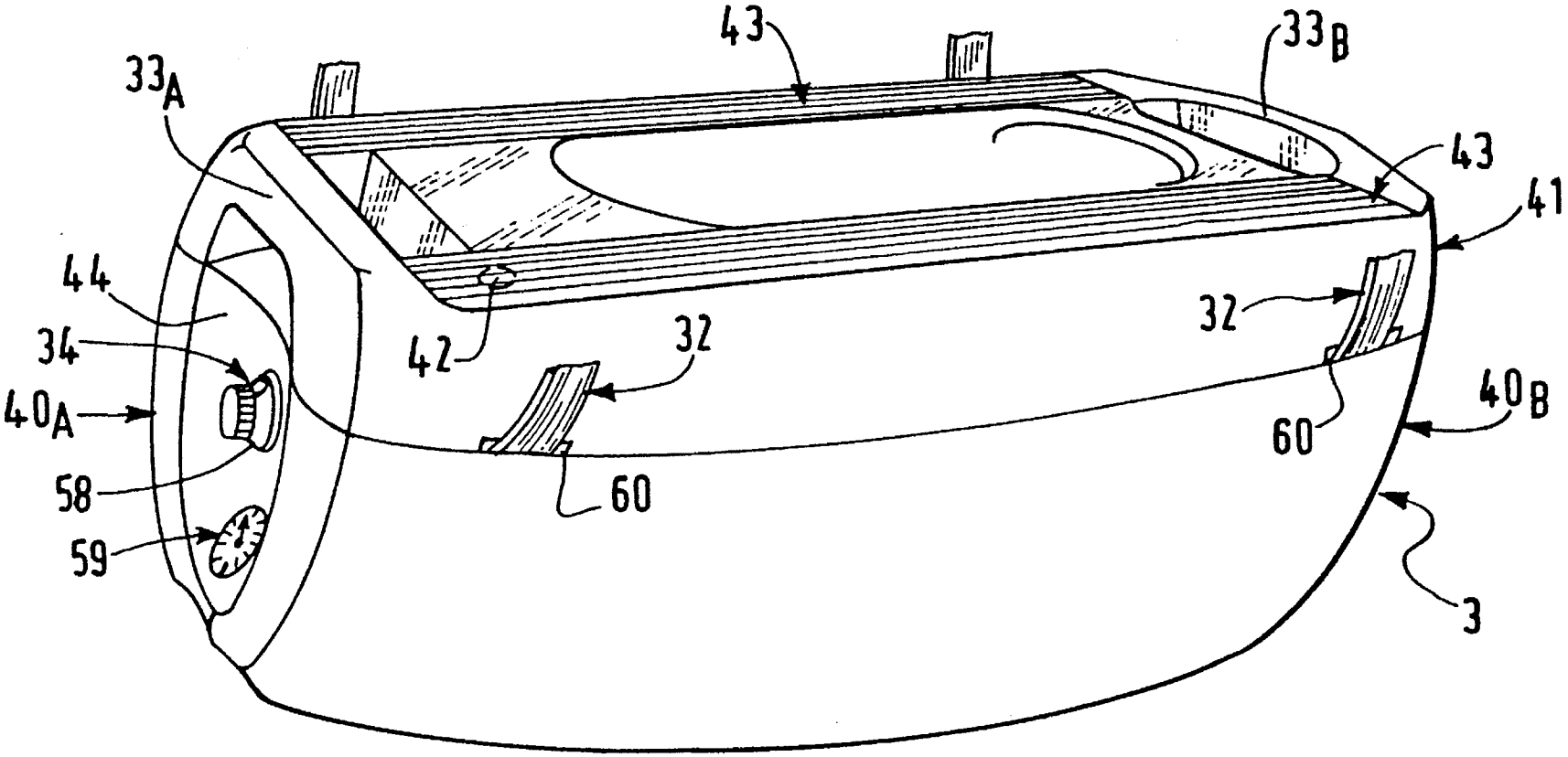
FIG. 5 is a perspective view of the gas reserve casing of FIG. 3.

In the embodiment illustrated in FIGS. 3 and 5, casing 3 is made by mounting two lower half-shells 40A, 40B and a cover 41, of rigid plastic material, for example, PVC, cover 41 being fixed to the half-shells 40 by means of screws such as 42. Cover 41 includes two opposite recesses defining two front and rear operating handles 33A and 33B, respectively. The upper part of cover 41 is substantially flat and is provided with two slotted bands 43 of elastomeric material used for mounting the utilizing apparatus 4 in a flexible and anti-friction manner on casing 3 while hiding screws 42 to prevent casing 3 from being dismantled. The latter is completed by a front partition 44 and a rear partition 45 which are blocked into members 40 and 41.

The bottle of mean pressure gas 8 is here made of two pressed parts 8A and 8B which are welded to one another, as seen in partial cross-section in FIG. 3, and are for example made of steel BS2 or BS3. Member 15 for rapid connection or for loading bottle 8 is mounted in a ring 46 which is welded in an opening of the lateral partition of the second front pressed part 8A inside the latter. Member 15 comprises here, in series, an upstream filter 47 and a downstream damper valve 48. Member 15 additionally comprises a front conically widening part 49 serving to guide and center the corresponding connecting member of the outlet head 16 of the loading casing 2, as will be seen later. Similarly, the low pressure reducer 14/flow regulator 34 assembly is mounted on bottle 8 by means of a ring 50 which is welded in an opening of the bottom of the front pressed part 8A, inside the latter, and including, by extending inside bottle 8, in series, upstream of the pressure reducer 14, an upstream filter 51, which protects the pressure reducer 14 against particles which may be present in bottle 8, for example calamine resulting from the manufacture of the bottle, and a holding valve 52 which ensures the maintenance of a residual pressure, of the order of $1{,}5\times10^5$ Pa, in bottle 8 and thus preventing, as in the case of valve 48, any entry of air in the latter. The holding valve 52 additionally ensures the function of damper valve.

A security against over-pressures in casing 3 is ensured, at the level of the pressure reducer 14, by means of a high pressure valve 53, which opens when the pressure in reservoir 8 exceeds a value of $50\times10^5$ Pa, and a low pressure valve 54, connected to the low pressure chamber of the pressure reducer 14, and preventing the production of a pressure in excess of about $2\times10^5$ Pa in the outlet channel 10, which extends, here, towards the rear of casing 3 until reaching connection 11 to the flexible duct 12 of the utilizing apparatus, the connection 11 mounted in the rear partition 45, being advantageously provided with a damper valve to maintain the channel 10 under pressure.

Bottle 8 is positioned and secured in casing 3 by means of a group of internal ribs 55 provided in members 40 and 41, between which are disposed foam lining 56, a foam carpet 57 being also disposed between the bottom of bottle 8 and the rear partition 45. The pressure reducer 14/flow regulator 34 assembly is positioned and maintained in the front partition 44 by means of an elastic ring 58 mounted in a central orifice of the partition 44. In the embodiment of FIGS. 3 and 5, casing 3 includes a manometer 59 mounted in the front partition 44 and connected to the low pressure zone of the pressure reducer 14. Casing 3 being adapted to be placed on the ground and displaced on the latter, the lower surfaces of the casing 3 are advantageously provided with anti-abrasion feet of polyamide (non illustrated). In this embodiment, the individual carrying of casing 3 and its attachment to the utilizing apparatus 4 are carried out by means of two straps 32 which extend through openings 60 formed in casing 3 and in which the inner side extends in contact with bottle 8 as seen in FIG. 3, so that straps 32 rest against bottle 8 when tightening the straps around the utilizing apparatus to fix it to the casing 3 and constitute the portable autonomous operating assembly.

Figure 4:
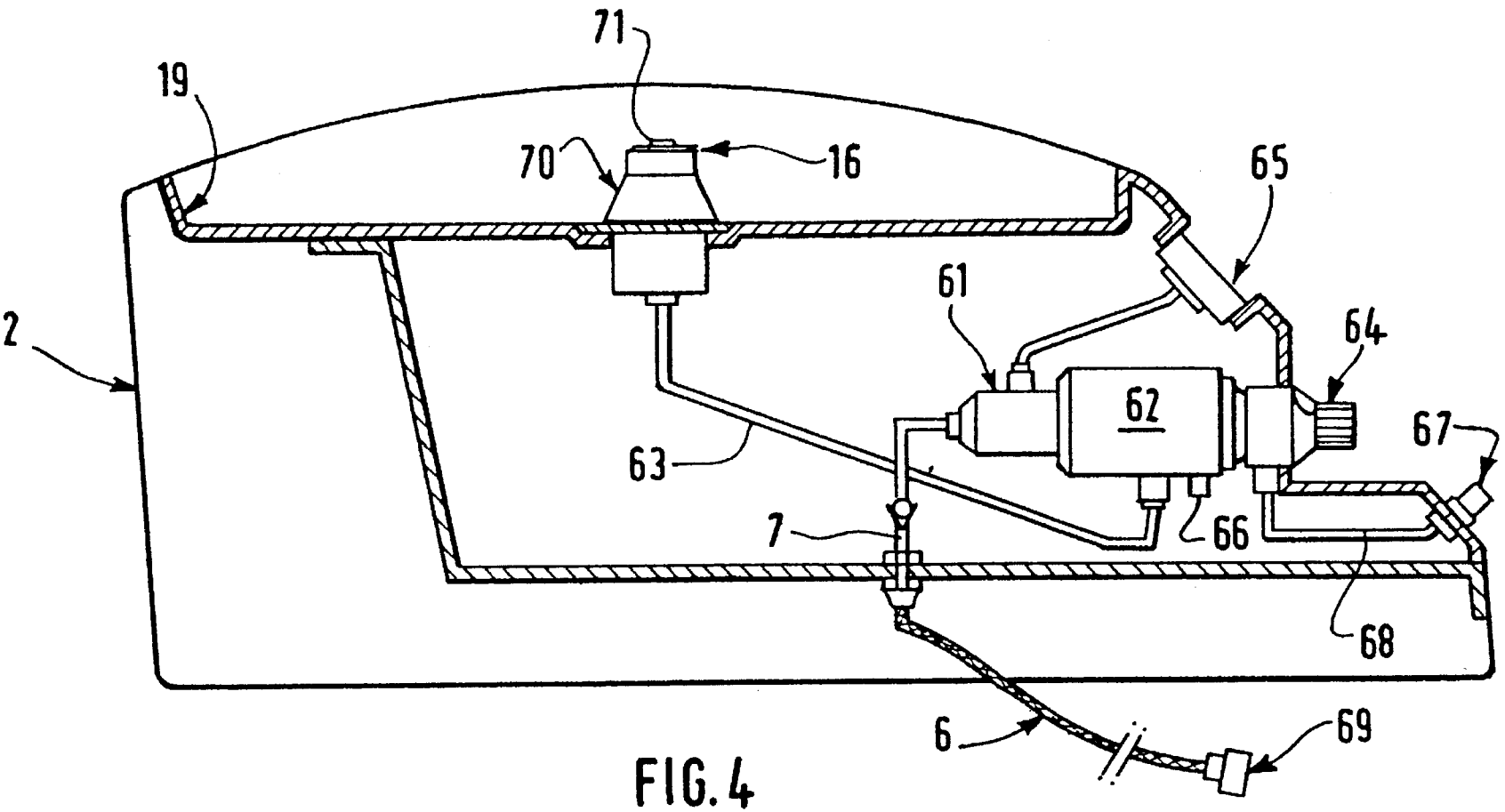
FIG. 4 is a longitudinal cross-section view of an industrial embodiment of a loading casing according to the invention adapted to the gas reserve casing of FIG. 3.

In the embodiment of FIG. 4, loading casing 2, still including, at its upper part, a recess 19 whose shape corresponds to the shape of the inferior part of casing 3, comprises here, in downstream series with respect to the internal duct for high pressure feed 7, directly connected to the source of high pressure gas, first pressure reducer 61 reducing the high pressure to a value lower than $100\times10^5$ Pa and a second pressure reducer 62 bringing back the pressure to a utilization pressure between 30 and $50\times10^5$ Pa in a transfer channel 63 connected at the connecting head 16 which is intended to cooperate with the connecting member 15 of the casing 3 and projecting in recess 19. The pressure reducer assembly 62, 63 is completed by means of a flow regulator 64 which projects outside casing 2. The high pressure in the first pressure reducer 62 is read on a manometer 65 mounted in casing 2. As for the low pressure reducer 14 of casing 3, the second pressure reducer—or mean pressure reducer—62 in casing 2 includes a safety valve 66 as a protection against over-pressure.

Advantageously, as illustrated in FIG. 4, casing 2 additionally includes a connecting member 67, provided with a damper valve, connected by means of a tubular member 68 to the outlet of the pressure reducer 62 and enabling to supply via casing 2, a fixed working station while preserving to the casing 2 its loading function for casings 3. To prevent the penetration of air, and therefore impurities, into the gas circuits, casing 2 is advantageously connected to the high pressure source 1 by means of a flexible duct 6 including a connecting end member 69 provided, as for end member 11 of casing 3 and end member 67 of casing 3, with a damper valve. Also as seen in FIG. 4, the connection head 16 of casing 2 here includes a truncated outer shape 70 intended to cooperate with the truncated inlet 49 of the connected member 15 and additionally includes a retractable tubular skirt 71 which protects the pusher-rod 30 of head 16 and which is pushed away by connecting member 15 when connecting the latter with head 16.

As seen in FIGS. 3 and 4, the flow regulator taps 34 and 64 of casings 3 and 2 are advantageously of the indexed type to provide a range of preset, pre-established flows.

Although the present invention has been described with reference to specific embodiments, it is not limited thereto but, on the contrary, it is capable of modifications and variants which will appear to one skilled in the art. In particular, as mentioned above, the utilizing apparatus 4 may be an oxygen-therapy or ventilation station, in which case the reservoir 1 is a reservoir of gaseous oxygen under pressure or a liquid oxygen combined reservoir-evaporator assembly.

We claim:

1. A gas supply device for supplying gas under pressure to a portable user apparatus, comprising, in a first portable casing, a gas container mounted in said first portable casing, a gas outlet circuit for fluidly connecting the gas container to the user apparatus, and a gas inlet circuit for connecting the gas container to a source of gas under pressure, the gas outlet circuit including a first pressure reducer and a first flow control valve, said first portable casing defining a support base on which said user apparatus is mounted when in use, and releasable connecting means independent of said gas outlet circuit for mechanically interconnecting together the first casing and the user apparatus to form a unitary transportable operating assembly.

2. The device of claim 1, wherein the gas inlet circuit comprises, in the first casing, a quick coupling member for connection to an outlet end of a stationary loading station in fluid connection with the source of gas.

3. The device of claim 2, wherein the loading station includes a second casing having a recessed part for housing a part of the first casing provided with the quick coupling member.

4. The device of claim 3, further comprising a second pressure reducer between the outlet end and the gas source.

5. The device of claim 4, wherein the second casing includes a second flow control valve between the outlet end and the gas source.

6. The device of claim 2, wherein the gas container is a small gas bottle having a peripheral wall, and the quick coupling member is mounted in the peripheral wall.

7. The device of claim 1, wherein the gas container is a small gas bottle carrying the first flow control valve.

8. The device of claim 1, wherein the first casing includes at least one handle.

9. The device of claim 1, wherein the first casing encompasses the gas container and includes an access opening for giving access to the first flow control valve.

10. The device of claim 1, wherein the user apparatus, which together with the first casing forms said transportable assembly, is a welding apparatus.

11. A gas supply equipment for supplying gas under pressure to a portable user apparatus comprising:

a filling station including an outlet head in fluid flow communication with a source of gas under pressure;

a transportable gas reserve assembly including a gas container, a gas inlet circuit having a filling head for quick coupling to the outlet head of the filling station, a gas outlet circuit including an end fitting for fluid flow connection to the user apparatus and a flow control valve, said gas reserve assembly defining a support base on which said user apparatus is mounted when in use, and releasable mechanical connecting means independent of said gas outlet circuit for interconnecting together the gas reserve assembly and the user apparatus.

12. The equipment of claim 11, wherein the gas outlet circuit includes a pressure reducing valve.

13. The equipment of claim 12, wherein the user apparatus is a welding apparatus.

14. The equipment of claim 11, wherein the gas container and the gas inlet and outlet circuits are housed in a first casing.

15. The equipment of claim 14, wherein the filling station includes a second casing having a recessed portion housing a portion of the first casing for coupling the outlet head to the filling head.

* * * * *